US005597283A

United States Patent [19]

Jones

[11] Patent Number: 5,597,283

[45] Date of Patent: Jan. 28, 1997

[54] QUICK COUPLING FOR HEAVY EQUIPMENT ATTACHMENT

[76] Inventor: Gordon Jones, 3309 SE. 179th, Portland, Oreg. 97236

[21] Appl. No.: 32,837

[22] Filed: Mar. 10, 1993

Related U.S. Application Data

[63] Continuation of Ser. No. 956,476, Oct. 2, 1992, abandoned, which is a continuation of Ser. No. 682,928, Apr. 9, 1991, abandoned.

[51] Int. Cl.[6] ..... E02F 9/00

[52] U.S. Cl. ..... 414/723; 37/468

[58] Field of Search ..... 414/723, 722; 403/322; 37/118 R, 118 A, 231, 468; 172/272–275

[56] References Cited

U.S. PATENT DOCUMENTS

| | | | |
|---|---|---|---|
| 3,556,323 | 1/1971 | Heimmermann | 414/723 |
| 3,818,551 | 6/1974 | Coughran, Jr. | 414/723 X |
| 4,881,867 | 11/1989 | Essex et al. | 414/723 |
| 4,955,779 | 9/1990 | Knackstedt | 414/723 |

*Primary Examiner*—Donald W. Underwood

[57] ABSTRACT

A quick coupling for attaching implements to heavy equipment includes a coupler that is rotatably attached to the stick and implement linkage of the equipment boom at attachment axes that are oriented at the preferred geometric relationship for that particular piece of equipment. The coupler is releasable attachable to a bracket that is attached to the implement. Thus, implements are interchangeably attached to equipment having different geometric relationships between their attachment axes. Bosses located on the coupler coaxially with the axis of rotation on the stick are received in conforming receptacles formed in the bracket. A wedge movable in tracks defined in the coupler upon activation of a piston cylinder engages cam surfaces on a coupling element located on the bracket to pull the bracket toward the coupler when the wedge is pulled downwardly. Mating surfaces on the coupler and bracket cause the bosses to be urged into the receptacles when the bracket is pulled toward the coupler. Thus, the wedge firmly couples the elements even when they have started to experience wear. Springs normally bias the wedge downwardly in the tracks so that the device will not become uncoupled upon loss of hydraulic pressure. The wedge is drilled to receive bolts that fit into threaded bores in the coupler, which allows the device to be coupled manually if desired.

7 Claims, 3 Drawing Sheets

QUICK COUPLING FOR HEAVY EQUIPMENT ATTACHMENT

This application is a continuation of application Ser. No. 07/956,476 filed Oct. 2, 1992, now abandoned, which in turn is a continuation of application Ser. No. 07/682,928 filed on Apr. 9, 1991, now abandoned.

BACKGROUND AND SUMMARY OF THE INVENTION

This invention relates to a quick coupling for attaching implements to the boom of a piece of heavy equipment, and in particular to a quick coupling that permits interchangeability of implements between different pieces of equipment.

Heavy equipment having booms are detachably coupled to the implement carried by the boom to permit the use of multiple types of implements. It is common for the equipment to be connected to the implements through a hydraulically-operated quick coupling in order that the implements can be coupled and uncoupled without having to leave the machine. Prior art quick couplings have several problems, however, which limit their use.

The major problem results from the fact that the boom and the implement together form a four-bar parallelogram linkage with the top link being attached to a piston cylinder, so that when the piston cylinder is extended or retracted the implement is rotated relative to the boom. This linkage requires two axes of rotation at the implement, and the geometric relationship between these axes is critical to maintaining the full range of implement rotation. However, different manufacturers of equipment use different geometric relationships and, as a result, a quick coupling on a particular machine can only be coupled with implements having a quick coupling configured for that machine. Thus, implements are not interchangeable between machines and an operator utilizing machines, from different manufacturers must have a duplicate inventory of implements.

In addition, most prior art quick couplings couple at the two implement axes of rotation. Thus, as the coupling elements start to wear, the coupling becomes loose and control is lost. Furthermore, the coupling elements often have a relatively small contact surfaces so that wear occurs quickly and the coupling elements are prone to premature breakage.

Another problem with prior art quick couplings is that the attachment axis on the stick, that the implement rotates around, is offset from where the attachment axis would normally be located on the implement. As a result the tip radius of the implement is altered by the use of the quick coupling. This also affects operation of the machine.

Finally, when prior art quick couplings are attached to a bucket, they are attached in a manner such that they can only be coupled when the bucket is oriented open-end up. As a result, when the bucket is stored it collects rain water, which leads to rusting.

The subject invention overcomes the foregoing shortcomings and limitations of the prior art quick couplings by providing a quick coupling having a coupler element that is attached to the boom at its normal attachment axes, thereby not interfering with the preferred geometric relationship between these axes. The coupler is configured to couple with a bracket that is attached to the implement. Thus, the coupling elements is the same for every machine and implements are completely interchangeable. This result is achieved by locating the first attachment axis on the stick at the same point on the coupler for every machine, and placing the second attachment axis on the implement linkage at a different point on the coupler for every machine.

In a preferred embodiment, cylindrical bosses are located on the coupler coaxial with the first attachment axis. Receptacles are placed at the bottom of the bracket on the implement which matingly receive the bosses. A wedge located at the top of the coupler is movable in a track by actuation of a piston cylinder. The operative face of the wedge interacts with cam surfaces on the bracket such that the bracket is pulled snugly against the coupler when the wedge is moved downwardly in the track. As the bracket moves toward the coupler, overlapping surfaces on the respective elements cause the bosses to be urged downwardly into the receptacles. Thus, when the wedge is moved downwardly by the piston cylinder, the coupler and bracket are snugly joined. Since this joinder is accomplished by a double wedge, wear of the elements does not affect the tightness of the coupling. In addition, the bosses, the wedge and the mating surfaces all have large surface areas which lessen the amount of wear that does occur and provides a strong coupling. Since the implement is rotated about bosses which are coaxial with the normal first attachment axis of the stick, the tip radius of the implement is not changed by the quick coupling.

In a preferred embodiment, springs are releasably attached to the wedge to normally urge it downwardly in the track. Thus, if the hydraulic system should fail the wedge will continue to be retained and the quick coupling will not open and release the implement. In addition, the wedge is drilled to receive bolts that can be engaged in threaded bores in a plate mounted in the coupler below the track. If necessary, the wedge can be engaged manually by inserting and tightening the bolts after the piston cylinder and springs have been disconnected.

Accordingly, it is a principal object of the subject invention to provide a quick coupling for attaching implements to heavy equipment which permits complete interchangeability between implements and machines from different manufacturers.

It is a further object of the subject invention to provide such a quick coupling in which the rotational geometry of the equipment is not altered from its preferred relationship.

It is a still further object of the subject invention to provide such a quick coupling which has large contact surfaces to minimize wear and breakage.

It is a further object of the subject invention to provide such a quick coupling in which wear of the coupling elements is automatically compensated for.

It is a yet further object of the subject invention to provide such a quick coupling in which the tip radius of implements used with the coupling are not altered.

It is a further object of the subject invention to provide such a quick coupling which, when used with a bucket, allows the bucket to be coupled and uncoupled when resting open side facing down.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
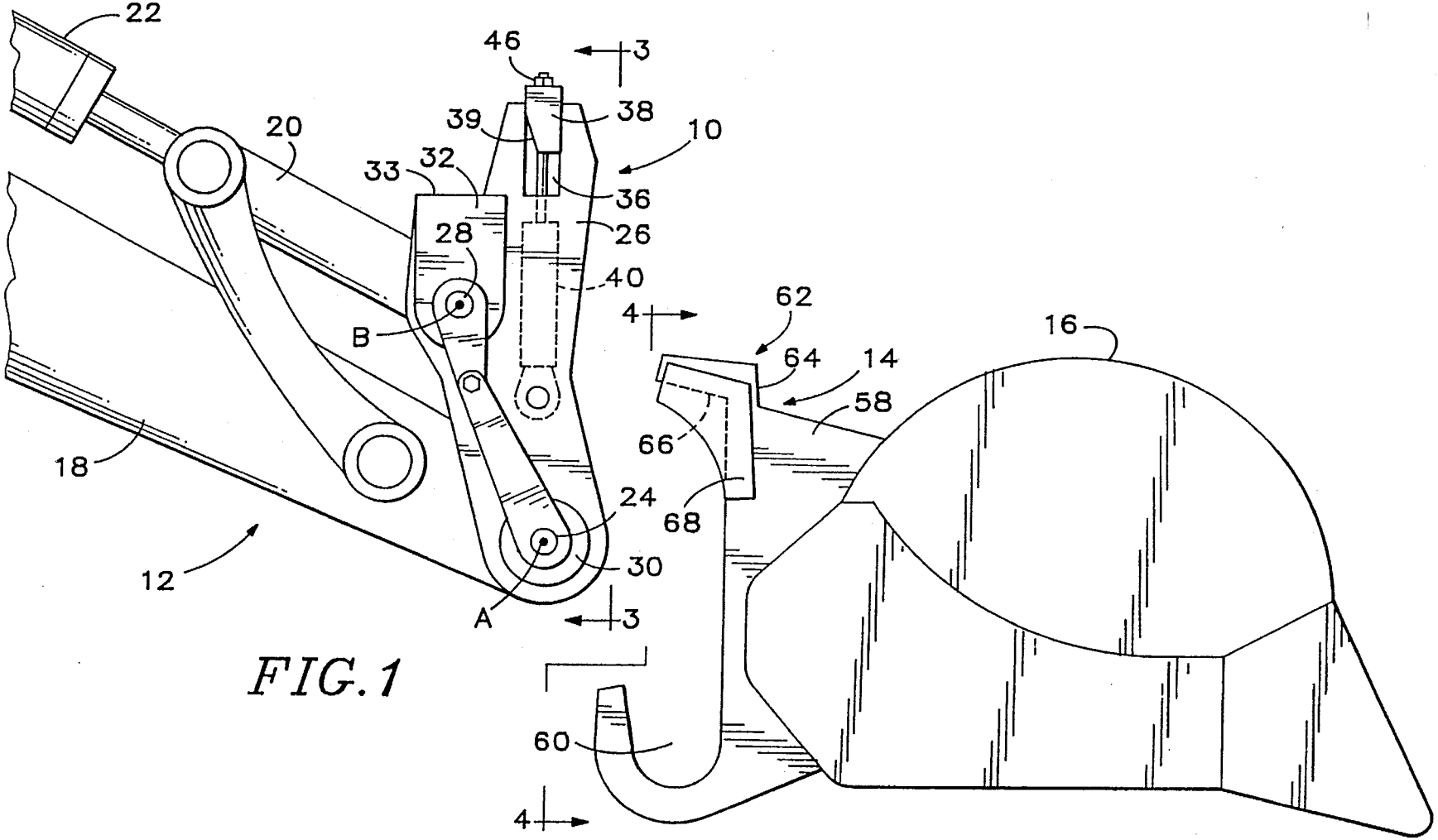
FIG. 1 is a side elevation view of a quick coupling embodying the features of the subject invention, in an uncoupled orientation.
Figure 2:
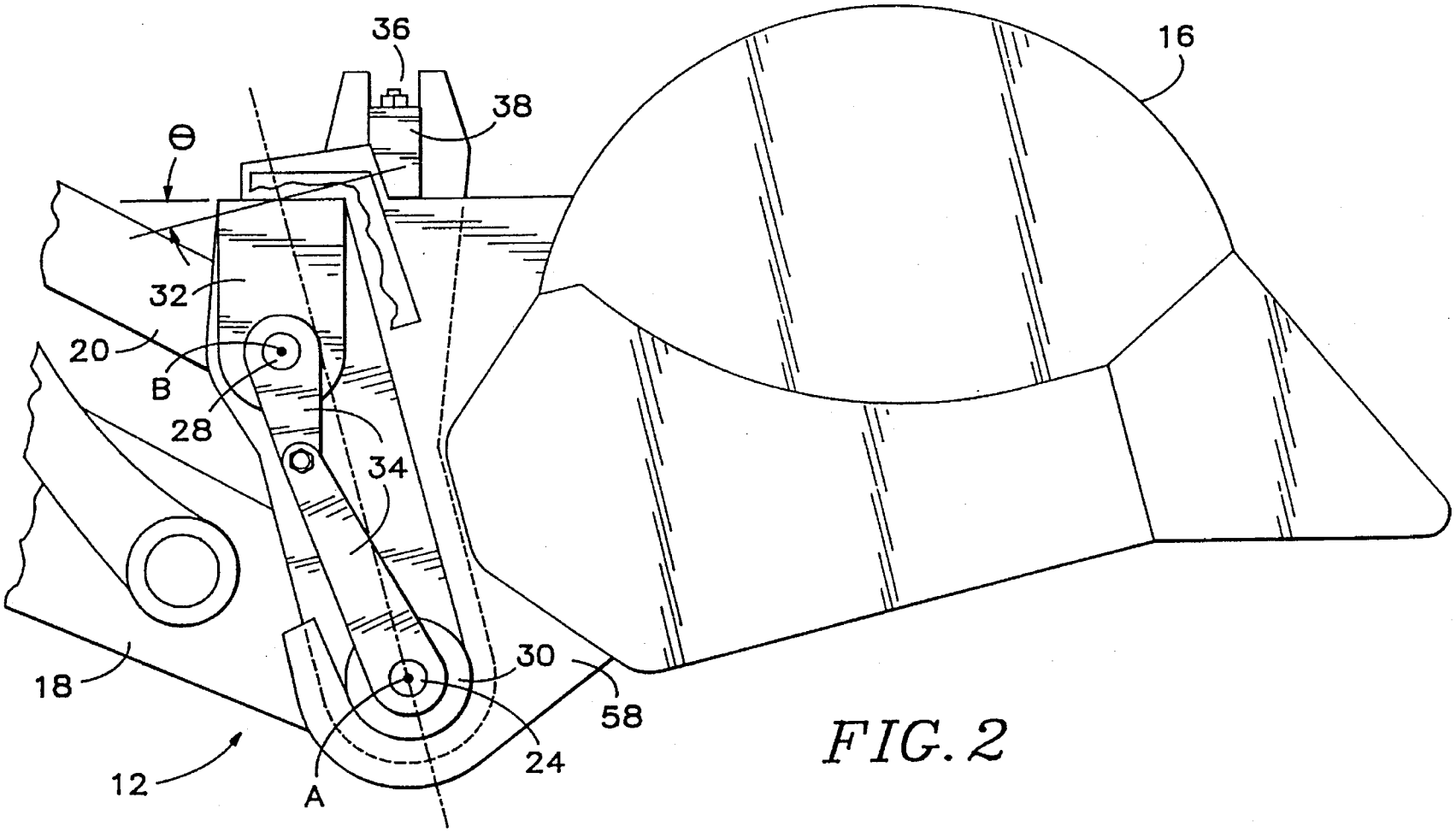
FIG. 2 is a side elevation view, similar to FIG. 1, of the quick coupling in a coupled orientation.

Referring to FIGS. 1 and 2 of the drawings, a quick coupling generally comprises a coupler 10 that is attached to the boom 12 of a piece of heavy equipment (not shown), and a bracket 14 that is attached to an implement 16. In the drawings, the implement is shown as a bucket, however, the quick coupling can be used with any type of implement including blades, hammers, rippers, compactors, grapples, etc. Likewise, the quick coupling can be used with any type of equipment that utilizes implements of this type, regardless of its purpose or size. Typical equipment having booms that carry detachable implements includes excavators, front loaders and backhoes.

In order to rotate the implement to facilitate its use, the boom 12 comprises a stick 18 and an implement linkage 20 that is movable by a piston cylinder 22. The piston cylinder 22 is fed by the equipment's hydraulic system and is actuated from the operator's controls. The coupler 10 is rotatably attached to the stick 18 through a first attachment axis A and to the implement linkage 20 through a second attachment axis B that is parallel with and separated from the first attachment axis A. The preferred geometric relationship between the first and second attachment axes is different for different manufacturers and different classes of equipment. The quick coupling of the subject invention allows this preferred geometric relationship to be maintained. This is accomplished by placing the bore that receives the shaft 24 that defines the first attachment axis A at the same location in the coupler side plates 26 on every machine. However, the bore that receives the shaft 28 that defines the second attachment axis B are different for each different machine, and is located so that the first and second attachment axes are in the preferred geometric relationship for that machine. Cylindrical bosses 30 are attached to the side plates 26 coaxial with the first attachment axis. The bosses 30 have central bores that also receive the shaft 24. Thus, the bosses provide additional support for the shaft. The shaft 24 extends rotatably through a bushing (not shown) located in the end of the stick 18. In order to achieve complete interchangeability, the side walls 26 are separated by a sufficient distance to receive the widest boom. Spacers (not shown) will be installed when the quick coupling is installed on equipment having a narrower boom.

Gusset plates 32 are attached to the side plates 26 around the location of the second attachment axis B. The gusset plates contain bores that receive the shaft 28 and thus provide additional support for the shaft. In addition, the gusset plates serve as platforms through which the bore that will receive the shaft 28 can be placed at the proper location. Finally, the gusset plates provide the contact surfaces between the coupler and the bracket. The top surfaces 33 of the gusset plates 32 are machined to provide bearing surfaces. The top surfaces 33 are offset at an angle θ which, in the preferred embodiment is approximately 15°, from a plane that is perpendicular to a plane that passes through the attachment axis A and the center of the top surfaces. The purpose of the top surfaces will be more fully explained later. The shaft 28 extends rotatably through a bushing (not shown) located in the end of the implement linkage 20. Plates 34 attached to one end of the shafts 24 and 28 and to one of the side plates 26 prevent rotation of the shafts in their bores. Thus, wear is limited to the bushings in the stick and implement linkage.

Figure 3:
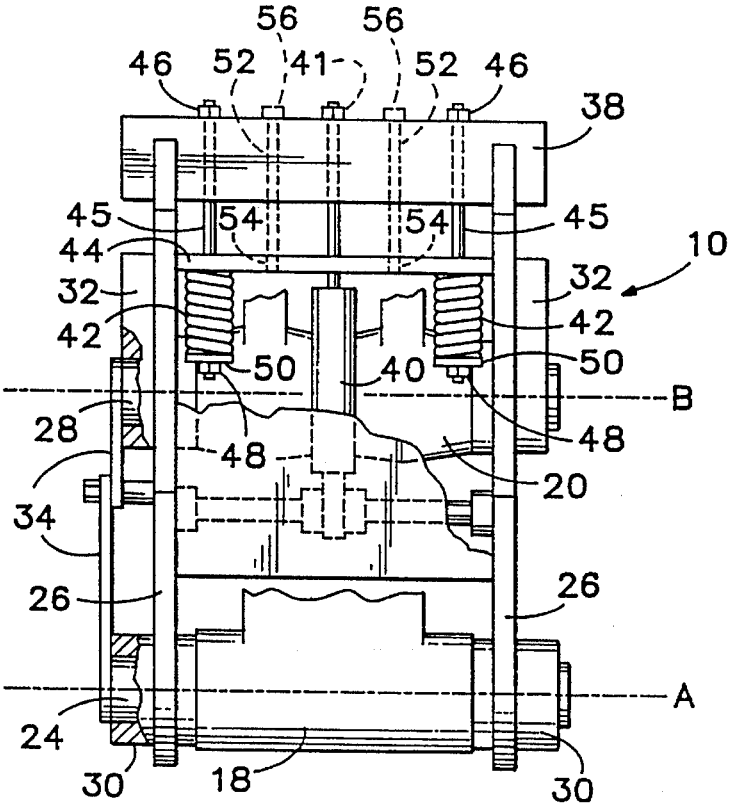
FIG. 3 is an end elevation view, partially broken away to show hidden detail, taken along the line 3—3 in FIG. 1.
Figure 4:
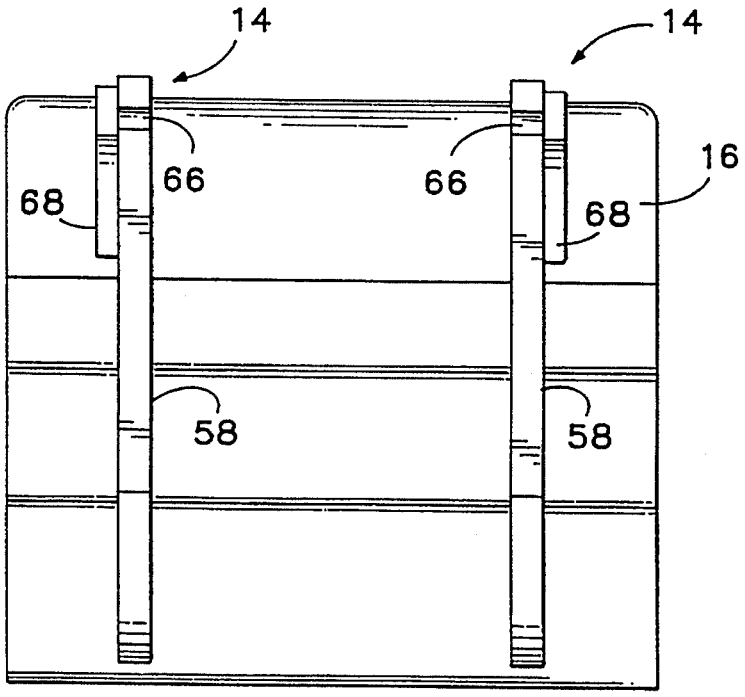
FIG. 4 is an end elevation view taken along the line 4—4 in FIG. 1.

Located at the upper ends of the side plates 26 are aligned tracks 36 which slidably carry an elongate wedge 38. The wedge has an operative face 39 which is angled with respect to the direction the wedge moves in the tracks. Preferably this angle is approximately 15°. Referring now also to FIG. 3, the wedge 38 is attached to the piston of a double acting piston cylinder 40 by means of a nut 41. Activation of the piston cylinder 40 by controls (not shown) located near the operator, will cause the wedge to be raised and lowered in the track. The wedge is normally urged downwardly towards a first position at the bottom of the track by springs 42. The springs 42 are positioned below a plate 44 that extends between the side plates 26 below the tracks. Threaded rods 45 pass through aligned openings in the plate 44 and wedge 38 and through the springs. Nuts 46 located at the tops of the threaded rods and nuts 48 and keepers 50 located at the bottoms of the threaded rods can be adjusted so that the springs will pull the wedge to the bottom of the tracks. Thus, the wedge will be pulled to the bottom of the tracks upon loss of hydraulic pressure, to create a failsafe lock as will be more fully explained later.

A second set of openings 52 is placed in the wedge and aligned threaded bores 54 are located in the plate 44. Thus, bolts 56 (shown in phantom line) can be used to manually pull the wedge to the bottom of the tracks if desired. When the wedge is manually operated situation the nuts 41 and 46 must be removed to deactivate the hydraulic system.

The bracket 14 is permanently attached to the implement 16, such as by welding. The bracket comprises a pair of parallel, side-by-side walls 58 that are separated from one another such that the side plates 26 of the coupler 10 will fit snugly between them. Located at the bottom of each wall 58 is a receptacle 60 which is configured to receive one of the bosses 30 on the coupler. The bosses are sized so that they extend beyond the side of the walls 58 in order to permit a bucket clamp, or thumb, to be mounted on them. Located at the top of each wall is a coupling element 62 that works in cooperation with the wedge 38 to couple the bracket to the coupler. The coupling element 62 includes a cam face 64 that is engaged by the operative face 39 of the wedge 38 when the coupling is seated in the bracket and the wedge is moved downwardly. The coupling element also includes contact surfaces 66 which overlie the top surfaces 33 of the gusset plates 32 when the coupling is seated in the bracket. A stiffener 68 is attached to the outside of each wall 58 adjacent to the coupling element 62 in order to provide rigidity and strength.

In operation, a detached implement is attached to the piece of equipment by manipulating the boom to place the bosses 30 into the receptacles 60. As can be seen in FIG. 1, if the implement is a bucket, attachment can be made with it resting on the ground open side facing down. Thus, the bucket can be stored without collecting water and being subjected to rust. When the bosses are seated in the receptacles, the piston cylinder 22 is extended to rotate the coupler until the gusset plates 32 contact the walls 58 of the bracket 14. The piston cylinder 40 is then retracted to pull the wedge 30 downwardly in the tracks 36. As the wedge moves downwardly its operative face 39 contacts the cam surfaces 64 on the bracket 14 and pulls the bracket up against the gusset plates 32. Simultaneously, as the contact surfaces 62 of the coupling elements are pulled into contact with the top surfaces 33 of the gusset plates, the bosses 30 are urged downwardly into the receptacles 60.

If the hydraulic system or the piston cylinder 40 should fail, the springs 42, acting through the rods 45 and nuts 46, will keep the wedge 38 seated against the coupling element 64. Also, the wedge can quickly be converted to manual operation if necessary. All that is required is to remove the spring assemblies, disconnect the piston cylinder 40 and install the bolts 56 through the openings 52 in the wedge and into the threaded bores 54 in the plate 44. The wedge can then be driven down against the coupling element by tightening the bolts 54.

Not only does the coupling element permit quick simple coupling but, due to the double camming action, wear is compensated for automatically. In addition, because the basic coupling elements are identical with respect to their ability to interconnect, regardless of the machine they are used on, implements incorporating the subject quick coupling are interchangeable and can be attached to any machine incorporating the quick coupling. Moreover, the geometry of the machine remains unchanged so that the implement can be moved through its full range of travel.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A quick coupling for attaching an implement, that is designed to be rotated about an implement rotational axis, to a piece of heavy equipment having a stick that is rotatably attached to a implement at a first attachment axis and a moveable linkage that is rotatably attached to an implement at a second attachment axis that is parallel with the first attachment axis, with the first and second attachment axes having a defined geometrical relationship with respect to one another such that the implement is rotated relative to the stick in a predetermined manner when the linkage is extended and retracted, said quick coupling comprising:

(a) a coupler that is attached to said stick and said linkage rotatably at said first and second attachment axes respectively, said coupler having at least one coupling element located thereon;

(b) a bracket that is attached to said implement, said bracket having receptacle means for releasably receiving said coupling element with said implement rotational axis being coaxial with said first attachment axis and said bracket being rotatable relative to said coupler about said implement rotational axis;

(c) said bracket having a first planar surface defined thereon;

(d) said coupler having a second planar surface defined thereon;

(e) said first and second surfaces being oriented to overlappingly engage one another when said coupling element is placed in said receptacle means;

(f) said first and second surfaces being angularly offset from a plane that is normal to a plane that extends through said implement rotational axis and bisects said second surface so that the interaction of said first and second surfaces causes said coupling element to be urged into said receptacle when said bracket is rotated towards said coupler; and;

(g) means located on said coupler and said bracket for rotating said bracket toward said coupler.

2. The quick coupling of claim 1 wherein said means for rotating comprises:

(a) a track defined in said coupler;

(b) a wedge which is slidable in said track; and (c) a cam surface on said bracket that is engaged by said wedge and causes said bracket to rotate toward said coupler when said wedge is moved in first direction in said track.

3. The quick coupling of claim 2 further comprising:

(a) a remotely operated piston cylinder that is releasably attached to said wedge; and (b) biasing means which normally urge said wedge in said first direction.

4. The quick coupling of claim 3 further comprising:

(a) said wedge having defined therein a plurality of openings that pass transversely therethrough;

(b) a plurality of bolts which fit through said openings;

(c) threaded holes located in said coupler that receive said bolts so that as said bolts are threaded into said holes, said wedge is moved in said first direction.

5. A quick coupler for attaching implements to heavy equipment having a boom that includes a stick and an implement linkage, said quick coupling comprising:

a. a bracket attached to the implement;

b. a coupler attached to the boom;

c. said coupler being rotatably attached to said stick and to said implement linkage through separate axes;

d. said coupler having a coupling element that is coaxial with the axis through which said coupler is attached to said stick;

e. said bracket having a receptacle that releasably receives said coupling element and allows said bracket to be rotated relative to said coupler about the axis through which said coupler is attached to said stick;

f. said bracket having a first planar surface defined thereon;

g. said coupler having a second planar surface defined thereon;

h. said first and second surfaces being oriented to overlappingly engage one another when said coupling element is placed in said receptacle;

i. said first and second surfaces being angularly offset from a plane that is normal to a plane that extends through the axis through which said coupler is attached to said stick and bisects said second surface so that the interaction of said first and second surfaces causes said coupling element to be urged into said receptacle when said bracket is rotated toward said coupler; and g. means for rotating said bracket toward said coupler.

6. The quick coupling of claim 5 further comprising:

(a) a track defined in said coupler;

(b) a wedge which is slidable in said track; and (c) a cam surface on said bracket that is engaged by said wedge and causes said bracket to move toward said coupler when said wedge is moved in a first direction in said track.

7. The quick coupling of claim 6 further comprising a remotely operable piston cylinder that is coupled to said wedge.

* * * * *